United States Patent [19]

Waldecker

[11] Patent Number: 4,494,585

[45] Date of Patent: Jan. 22, 1985

[54] FUNNEL HAVING A PRIMARY VENT AND AN AUXILIARY VENT/SIPHON

[76] Inventor: Donald E. Waldecker, P.O. Box 3342, Falls Church, Va. 22046

[21] Appl. No.: 463,915

[22] Filed: Feb. 4, 1983

[51] Int. Cl.[3] ..... B65B 3/04; B67C 11/00

[52] U.S. Cl. ..... 141/98; 141/297; 141/331; 141/340; 285/181

[58] Field of Search ..... 285/181, 184, 401, 402; 141/98, 331–345, 199–205, 285–310

[56] References Cited

U.S. PATENT DOCUMENTS

| | | | |
|---|---|---|---|
| 235,123 | 12/1880 | Bovey | 141/18 |
| 426,165 | 4/1890 | Brittin | 141/339 |
| 911,262 | 2/1909 | Perry | 220/66 |
| 1,219,000 | 3/1917 | High | 165/73 |
| 1,358,218 | 11/1920 | Kominsky | 141/339 |
| 1,402,126 | 1/1922 | Roberts | 220/86 |
| 1,498,900 | 6/1924 | Barnett | 220/334 |
| 1,524,833 | 2/1925 | McCrackan | 137/142 |
| 1,705,312 | 11/1927 | Rovano | 141/297 |
| 1,810,822 | 4/1929 | Erickson | 141/126 |
| 1,964,644 | 6/1934 | Nall | 222/88 |
| 2,052,344 | 8/1936 | Edelmann | 222/155 |
| 2,584,216 | 2/1952 | Morrison | 141/300 |
| 2,811,181 | 10/1957 | Correll | 141/340 |
| 3,177,907 | 4/1965 | Baldi | 141/300 |
| 3,750,722 | 8/1973 | Nowak | 222/460 |
| 3,927,703 | 12/1975 | Beaubien | 141/333 |
| 4,130,147 | 12/1978 | Langlie et al. | 141/333 |
| 4,273,166 | 6/1981 | Bradley | 141/95 |

FOREIGN PATENT DOCUMENTS

| | | |
|---|---|---|
| 11405 | 4/1903 | Austria . |
| 707856 | 4/1931 | France . |
| 806159 | 9/1936 | France . |
| 18436 | of 1901 | United Kingdom . |

*Primary Examiner*—Houston S. Bell, Jr.
*Attorney, Agent, or Firm*—Glenn E. Wise

[57] ABSTRACT

A funnel device for filling containers having either vertically or otherwise oriented filling inlets with fluent material. The device is adapted when in use to be supported by a given container's filling inlet, and is orientable relative to such inlet so as to be capable of receiving and conducting fluent material to such container while a user has free use of both hands. To increase filling speed, the device is provided with a novel venting system which is designed to rapidly vent a large volume of air or gas in a safe manner from a container being filled with the device. Part of the venting system may also be manipulated to form a siphon which can be used to drain excess material from the funnel device in the event the container is overfilled.

15 Claims, 8 Drawing Figures

Fig. 5
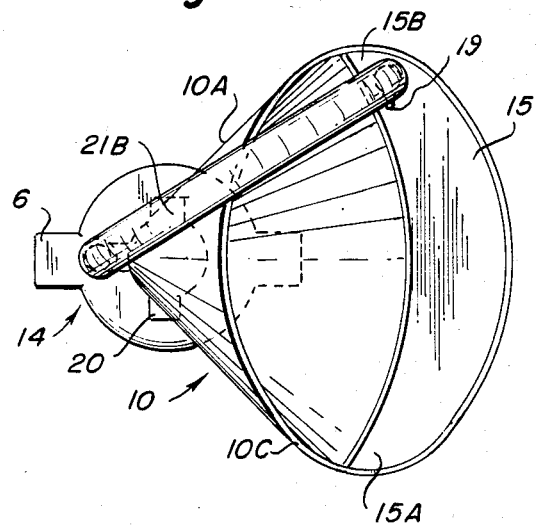
Fig. 8
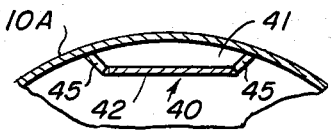
Fig. 6
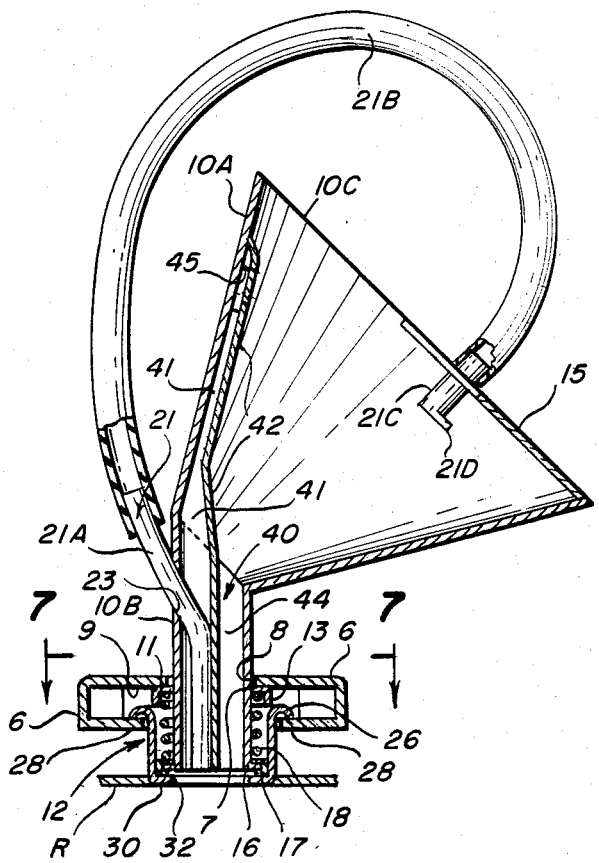
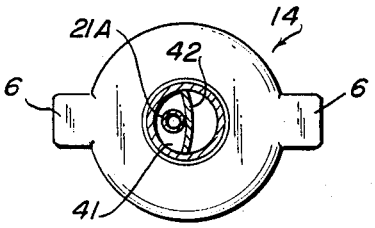
Fig. 7

FUNNEL HAVING A PRIMARY VENT AND AN AUXILIARY VENT/SIPHON

This invention relates to a funnel for use in filling containers, such as for filling the radiators of automotive vehicles or for filling other types of containers, and more particularly to a funnel which includes in combination therewith a primary vent and an auxiliary vent/siphon.

DESCRIPTION OF THE PRIOR ART

The filling openings for most automotive radiators of the prior art have been of the vertical fill type; that is the longitudinal axis of the filling opening of such prior art automotive radiators lies in a vertical plane. However, in recent years, some automotive vehicles have been provided with radiators having filling openings which are inclined relative to the vertical plane. Also liquid containers other than automotive radiators, although they are probably most often provided with vertical filling openings, sometimes are provided with inclined filling openings, and even filling openings, the longitudinal axes of which are substantially, or truly horizontal.

Some of the funnels which are known in the prior art can be used for filling containers including the radiators of automotive vehicles which have vertical, horizontal or inclined filling openings by properly orienting such funnels. However, to the best of my knowledge, there is no prior art unitary funnel construction which has been specifically designed for safe, leak-proof, hands-free filling of containers having vertical or inclined or horizontal filling openings.

U.S. Pat. Nos. 235,123, issued to G. C. Bovey on Dec. 7, 1880, and 911,262 issued to J. D. Perry on Feb. 2, 1909 both show funnels useful with containers having inclined filling openings. Neither of these patents teaches utilization of the funnels therein with horizontal or vertical filling openings.

U.S. Pat. No. 1,219,000 issued to J. B. High on Mar. 13, 1917, shows, in FIG. 7 thereof, a funnel which is swivelly mounted with respect to the filling inlet of the radiator of an automotive vehicle in such manner that in one swivel position, the axis of the inlet end of the funnel is horizontal to collect cooling air for the radiator, whereas in another swivel position of the funnel, the axis of the funnel is vertically arranged to permit introducing liquid into the radiator through the funnel.

U.S. Pat. No. 1,402,126 issued to T. M. Roberts on Jan. 3, 1922, shows a radiator cap having a funnel attached thereto, the funnel being swivelly connected to the base portion of the radiator cap in such manner that in one of two alternative positions of the funnel, the axis of the funnel is directed horizontally, whereby to collect cooling air for the radiator, whereas in the other alternative position of the funnel, the axis of the funnel is directed vertically to permit the introduction of liquid into the radiator.

Neither of the patents just mentioned, namely U.S. Pat. No. 1,219,000—High, or U.S. Pat. No. 1,402,126—Roberts, is intended in its present form to be used interchangeably either with an automobile radiator, or other container, having an inclined filling opening of the type illustrated in FIG. 1 of the present application, or having a vertical filling opening of the type illustrated in FIG. 2 of the present application. Nor do these two patents suggest utilizing the devices thereof with containers having horizontal filling openings. Further, both the High and Roberts patents show constructions having swivel joints in their fluid flow paths, which joints, particularly if their devices were somehow converted to general purpose funnels rather than being relatively stationary structures as shown would soon be prone to leakage due to normal wear and tear.

U.S. Pat. Nos. 426,165, issued on April 22, 1890 to J. T. Brittain; 1,964,644, issued on June 26, 1934 to E. L. Nall; and 3,750,722, issued on Aug. 7, 1973 to Roger L. Nowak all show other prior art funnels which by proper orientation of such funnels could conceivably be used with containers having either vertical or inclined filling openings, but not in the same fashion or with the same safety and stability as with my funnel. Utilization of the funnels of these latter three patents with horizontal filling openings, for example, would require manually cocking the funnels upwardly, if they could be used at all.

U.S. Pat. No. 3,927,703, issued to E. E. Beaubien on Dec. 23, 1975, teaches a two part funnel, one part of which can be used alone with containers having vertical fill openings, and the other part of which can be added for use in filling containers having inclined fill openings. Again, as mentioned relative to High and Roberts above, the normal wear and tear of use makes the joint means in Beaubien prone to leakage, and the two-part aspect of his funnel construction opens the possibility for loss or mis-placement of one part, or the other.

One feature of the construction of the funnel of the present application is that the funnel, which has a conical funnel portion whose axis of symmetry is inclined relative to the longitudinal axis of an outlet pipe which is integral with the funnel portion and also to the filling opening into which the funnel outlet pipe extends, is manually rotatable with respect to, and extends through a coupling member which is carried by the funnel outlet pipe and secures the funnel to the filling inlet of the container to be filled such as the radiator of an automotive vehicle. This feature permits the funnel to be rotatably adjusted to different angular positions about the longitudinal axis of a container's filling opening to permit orientation of the funnel to a position whereby it can be used for filling the container whether the container has a vertical or inclined or horizontal filling opening. This rotatable mounting of applicant's funnel relative to its attaching coupling is of further significance, if the funnel includes a screw-on, lug, or bayonet type coupling, and the coupling, when tightened, causes the inlet end of the conical funnel portion, whose axis is inclined relative to the central axis of the coupling and of the filling opening, to be located at a place where it is difficult or inaccessible for pouring liquid into. With applicant's rotatable mounting arrangement of the funnel relative to its mounting coupling, if the coupling stops, when tightened, at a place which is inconvenient for pouring of liquid into the conical funnel portion, the funnel can be rotated relative to its mounting coupling to move the conical funnel portion to a position in which it is more accessible for pouring liquid into same. U.S. Pat. No. 2,811,181 issued to W. L. Correll on Oct. 29, 1957, is one example of a lug-type coupling carried by a funnel. The coupling in this patent is rigid, i.e., non-rotatable, relative to the funnel.

It is well known, in a broad sense, to provide venting pipes or the like in conjunction with filling arrangements for automotive radiators or other containers, whereby the air in the radiator or other container which is displaced by the liquid being supplied can pass outwardly through such venting means. Venting arrangements of the type just broadly described are shown by U.S. Pat. Nos. 1,498,900, issued to Alan E. Barnett on June 24, 1924; 1,705,312 issued to Peter Rovano on Mar. 12, 1929; 1,810,822, issued to John E. Erickson on June 16, 1931; 2,584,216—issued to Gilbert H. Morrison on Feb. 5, 1952; and 3,177,907 issued to Frank L. Baldi on April 13, 1965. Also, French Pat. Nos. 806,159 of 1936, and 707,856 of 1931, both show the use of vent pipes in conjunction with funnels.

British Pat. No. 18,436 of 1901 shows the use in conjunction with a funnel, of both a vent pipe for venting air displaced by the liquid introduced through the funnel and also shows a separate siphon for draining liquid from a container which has been filled through the funnel.

U.S. Pat. No. 4,273,166—issued to Alan B. Bradley on June 16, 1981, shows a combination funnel and siphon in which the lower end of the siphon tube communicates with the container being filled during the filling operation, and wherein the outlet of the siphon tube can be moved from a storage position to a siphon position when there is an overfill of liquid in the funnel.

U.S. Pat. Nos. 1,524,833, issued to R. F. McCrackan on Feb. 3, 1925, and 2,052,344 issued to L. Edelmann on Aug. 25, 1936, also show fill or siphon tubes the outlet ends of which may be stored in a raised position when not in use.

STATEMENT OF THE INVENTION

Accordingly, it is an object of the present invention to provide a funnel which is adapted to be used in filling containers having the conventional vertical filling openings in which the longitudinal axis of such openings each lie in a vertical plane; or, alternatively, for filling containers having filling openings the longitudinal axes of which are either horizontal, and therefore perpendicular to a vertical plane, or are inclined relative to such plane.

It is a further object of the invention to provide a funnel including a cone-shaped funnel portion having an axis of symmetry which is at an inclination or angle with respect to an integral funnel outlet pipe. The funnel is attachable when desired to the filling opening of a container, such as an automotive radiator, or the like, by means of a coupling carried thereby. The funnel is rotatable with respect to the coupling so as to permit movement of the funnel about the axis of the outlet pipe of the funnel to various positions for the convenience of the user of the funnel in pouring liquid into the funnel when it is coupled to a container's fill opening.

It is a further object of the invention to provide a funnel including a baffle means which serves as a dam to prevent loss of liquid from the funnel when the funnel is in a fill position in which the axis of symmetry of the cone-shaped portion of the funnel extends at an angle relative to a vertical plane.

It is a further object of the invention to provide a funnel including a primary venting arrangement for venting gas or air displaced from the container during the filling of the container, the primary venting means being built into the interior of the funnel structure, with the discharge for the matter vented by the primary venting arrangement being so located relative to the funnel that such a primary venting means substantially prevents any liquid alone, or liquid entrained in the gas or air being vented from impinging against the person using the funnel. This is particularly important when toxic, caustic, or hot liquids are involved.

It is a further object of the invention to provide, in combination with a funnel, an auxiliary vent/siphon tube arrangement including means for holding the vent/siphon tube while venting is taking place in a position relative to the funnel in which gas or air-entrained liquid, discharged from the interior of the container through the vent means along with venting gas or air, is directed in such manner as not to impinge against the person using the funnel. Again, this is particularly important where toxic, caustic or hot liquids are involved.

In achievement of these objectives there is provided in accordance with an embodiment of the invention a funnel assembly comprising a funnel including a hollow conical funnel portion adapted to receive a fluent material to be dispensed by the funnel member. The funnel member includes an outlet pipe rigidly secured to the smaller or outlet end of the hollow conical portion, the outlet pipe lying on an axis which is at an angle relative to the axis of symmetry of the conical portion of the funnel. A baffle member is attached to and extends radially inwardly from the upper peripheral edge of the large end of the conical portion of the funnel, the baffle member overlying or covering a substantial portion of the mouth of the conical portion of the funnel, whereby to serve as a dam which prevents loss of fluent material from the conical portion when the axis of symmetry of the conical portion is inclined relative to the vertical plane. The funnel assembly includes a coupling member which is slidably and rotatably mounted on the outlet pipe, the coupling member being adapted to detachably engage the fill opening of a container to be filled by the funnel. The mounting of the coupling member on the funnel outlet pipe for relative rotation between the outlet pipe and the coupling member permits adjustment of the angular filling position of the conical funnel portion relative to the container to be filled.

The funnel assembly includes as part thereof an auxiliary vent/siphon subassembly including conduit means having an inlet located at the outlet of the funnel outlet pipe, such conduit means being alternatively positionable to place same either in fluid communication with both the conical funnel portion and with the container fill opening for venting of air or gas, as well as any liquid entrained by such air or gas, displaced from the container being filled during the filling operation, or to permit siphoning of excess fluid from the funnel, if required. A further feature of the construction of the funnel assembly is a primary vent means which is in parallel flow relation during venting with the auxiliary vent/siphon subassembly. The primary vent includes a hollow wall portion attached to part of the conical funnel portion and a vent passage fluidly communicating the hollow wall portion with the upper end of the container being filled, the hollow wall portion including discharge outlet means contiguous the upper end thereof for venting air or gas, as well as any liquid entrained by such air or gas, or spurting liquid alone, displaced from the container in such fashion as to substantially prevent impingement of vented matter onto the person using the funnel.

Further objects and advantages of the invention will become apparent from the following description taken in conjunction with the accompanying drawings in which:

DESCRIPTION OF THE DRAWINGS

FIG. 5 is a top plan view of the funnel of the invention;

FIG. 6 is a view, partially in vertical section taken on line 6—6 of FIG. 4 of the funnel of the invention, showing details of the primary vent and the auxiliary vent/-siphon, as well as the manner in which the outlet pipe of the funnel, the rotatable coupling member carried by the funnel outlet pipe, and the radiator inlet fitment are interrelated when the funnel is mounted on the radiator for use;

FIG. 7 is a view in section taken along line 7—7 of FIG. 6 with the top wall portion of the radiator shown in FIGS. 3, 4 and 6 being omitted for clarity; and FIG. 8 is a view in section taken along the line 8—8 of FIG. 4.

DESCRIPTION OF THE PREFERRED EMBODIMENT

Figure 1:
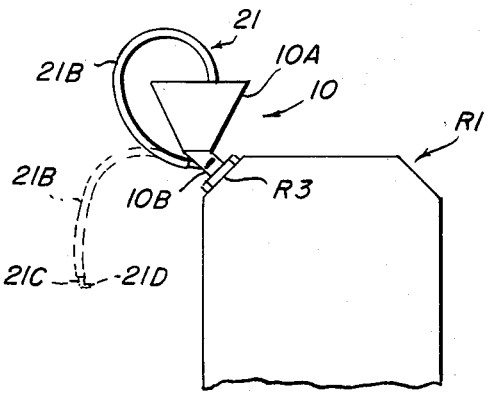
FIG. 1 is a schematic view showing the funnel of the invention mounted on an angular fill-type radiator of an automotive vehicle.

Referring now to the drawings, there is shown a combined funnel generally indicated at 10. Funnel 10 is shown as being removably attached to a conventional automotive radiator inlet fitment generally indicated at 12, to be further described, which fitment is rigidly attached to a radiator only a small upper portion of which is shown at R. Funnel 10 will be described in connection with filling the radiator of an automotive vehicle with a liquid such as anti-freeze, or any other liquid which it is desired to introduce into the cooling system of the automotive vehicle. However, it is obvious that the funnel may also be used in any application in which it is desired to introduce liquid, or even flowable solid materials such as a powder, into a container, such as, for example, introducing gasoline into the gasoline tank of an automotive vehicle, or caustic material into a receptacle.

The funnel, 10, comprises a hollow truncated conical funnel portion 10A which is integral with and discharges into an outlet pipe 10B. The axis of symmetry of the conical portion 10A is at an angle of approximately 45° with respect to the longitudinal axis of the funnel outlet pipe 10B.

Figure 4:
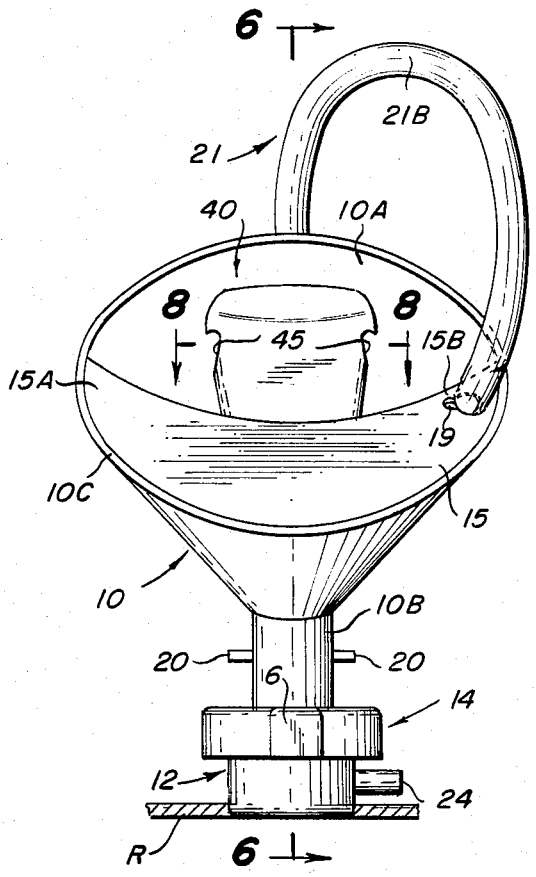
FIG. 4 is a view in side elevation of the funnel of the invention shown attached to the radiator supported inlet fitment of FIG. 3.

The larger end of conical funnel portion 10A terminates in a rim 10C of substantially circular shape, and a baffle member 15 is secured within rim 10C, for example, by welding or brazing, not shown, and extends in a plane perpendicular to the axis of symmetry of conical funnel portion 10A in overlying relation to approximately the lower half of the area of the mouth of the funnel portion 10A as seen in FIGS. 4, 5 and 6.

As best seen in the views of FIGS. 4 and 5, baffle member 15 is of crescent shape, and includes oppositely disposed outer tip portions 15A and 15B which form the highest portions of the baffle member when the funnel is inclined relative to the horizontal plane as viewed in FIGS. 2, 3, 4, 5, and 6.

Figure 2:
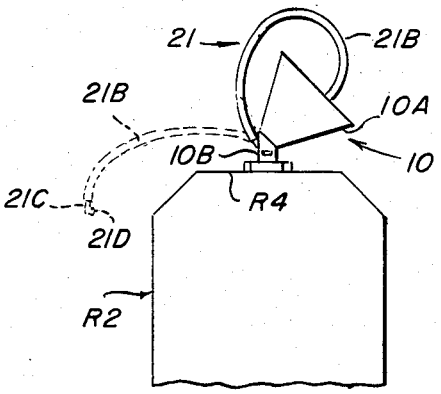
FIG. 2 is a schematic view showing the funnel of the invention mounted on a vertical fill-type radiator of an automotive vehicle.
Figure 3:
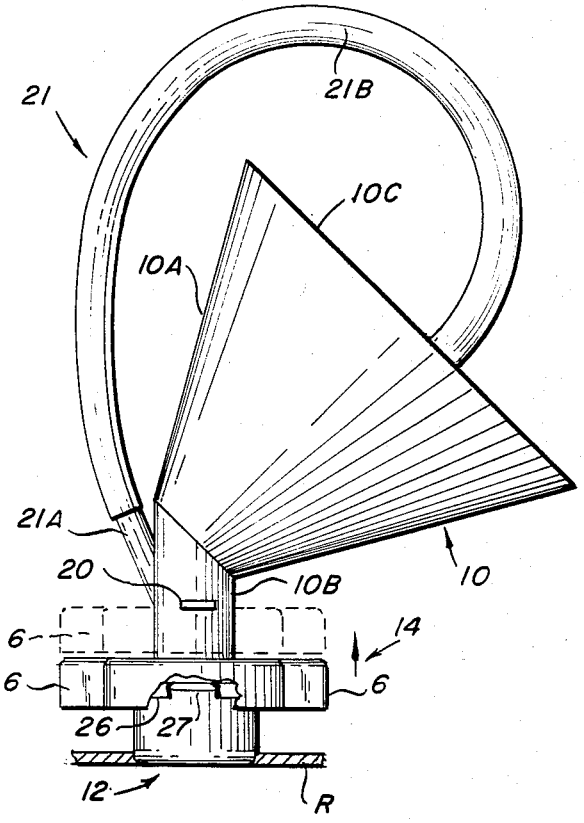
FIG. 3 is a view in front elevation of the funnel of the invention shown attached to a standard radiator inlet fitment such fitment being shown, by way of illustration, as being installed, by means of welding or the like not shown, within an aperture in a portion of the top wall of an automobile radiator of which the fitment forms the filling inlet.

When funnel 10 is mounted on a vertical fill radiator in a position such as that shown in FIG. 2 in which conical funnel portion 10A is inclined relative to the horizontal plane, baffle member 15 serves as a dam which prevents the liquid, or other fluent material, which is poured into funnel 10, from running over the lower portion of rim 10C which it could do if baffle 15 was not present, and if the liquid, or other fluent material, was poured so rapidly into portion 10A so as to "back up" therein.

A key-holed shaped aperture 19 is provided in outer tip 15B of the crescent-shaped baffle member 15 to receive the discharge end tube 21C of an auxiliary vent/siphon subassembly, designated generally as 21, when the vent/siphon subassembly 21 is in the vent position, as best seen in FIG. 6. When the discharge end tube 21C of vent/siphon subassembly 21 is "parked" in the position just described, the discharge end tube 21C is directed downwardly toward the interior of conical funnel portion 10A beneath baffle 15, whereby to minimize the possibility of the impingement of venting matter directly onto the person using the funnel, or onto other persons in proximity to the funnel. The aperture 19 in tip 15B of baffle 15 which receives the discharge end tube 21C of the vent/siphon subassembly is at a vertical level higher than the maximum level normally reached by liquid or other fluent material in conical funnel portion 10A when funnel 10 is in the inclined position shown in FIG. 6 of the drawings. Hence there is no danger that the liquid or other fluent contents of conical funnel portion 10A will escape through aperture 19 in tip 15A of crescent-shaped baffle 15 when funnel 10 is in the inclined filling position shown in FIG. 6 of the drawings since an overfilling of the funnel portion 10A, should it happen, will cause the liquid or other fluent material being placed in the funnel to flow over the low, central portion of baffle member 15 before it reaches the level of aperture 19.

As noted above, aperture 19 is key-hole shaped for the purpose of receiving a latching detent 21D on tube 21C therethrough when such detent is properly oriented. Tube 21C is fastened, by friction, or by adhesive, not shown, in one end of a flexible conduit 21B in such fashion that conduit 21B must be manually twisted slightly in order to orient detent 21D on the end of tube 21C to enter or leave aperture 19. Thus the interrelationship of parts 19, 21C and 21D, plus the flexible character of conduit 21B serves to retain tube 21C in its "parked" or venting position when it is located in the position shown in FIG. 6 if no twist is applied to conduit 21B such as to align detent 21D with the offset portion of aperture 19.

As seen in the view of FIG. 1, the funnel 10 with its auxiliary vent/siphon subassembly 21 may be mounted on an angular fill type radiator of an automotive vehicle or the like, designated generally as R1, in which the fill opening of the radiator is mounted on an upper side-wall surface R3 of the radiator, which side-wall surface in the illustrated embodiment lies in a plane inclined substantially 45° to the horizontal plane. Thus, in the use embodiment illustrated in FIG. 1, the axis of funnel outlet pipe 10B extends perpendicularly to the plane of side-wall surface R3 and hence, the axis of conical funnel portion 10A, when portion 10A is correctly positioned, extends in a vertical plane to provide a vertical fill for the liquid being poured into conical funnel portion 10A. On the other hand, in FIG. 2, the funnel assembly is illustrated as being used to fill the radiator, designated generally as R2, of an automotive vehicle in which the radiator is of the vertical fill type in which the fill opening for the radiator is positioned perpendicularly to the upper horizontal surface R4 of the radiator. Hence when outlet pipe 10B of funnel 10 is coupled, in a manner to be described, with the radiator fill opening in the use embodiment of FIG. 2, the outlet pipe 10B extends perpendicularly to the horizontal plane of surface R4, and thus the axis of the conical portion 10A of funnel 10 is inclined at an angle of approximately 45° relative to both the horizontal and vertical planes. Thus, the baffle member 15, when portion 10A is correctly positioned, serves as a dam which prevents loss of liquid from the low side of conical portion 10A of the funnel, when the funnel is mounted as shown in the view of FIG. 2 in the event liquid is poured in the funnel 10 so as to rise above the low side of rim 10C.

As best seen in the view of FIG. 6, funnel outlet pipe 10B has slidably and rotatably mounted thereon a captive coupling which is designated generally at 14 and which operates similarly to automobile radiator caps in current use insofar as it is adapted to be detachably engaged with standard fitments of the type shown at 12 which provide the filling openings of present day radiators of either the angled fill type shown in FIG. 1 or of the vertical fill type shown in FIG. 2. Funnel outlet pipe 10B terminates at the lower end thereof in a radially outwardly extending annular flange 16 which retains coupling member 14 captive on funnel outlet pipe 10B. Flange 16 carries a gasket 17, to be further described, the top of which serves as a bottom spring seat for a helical spring 18 which bears at its upper end against surface 11 of apertured top spring seat 13 which is attached, by welding or the like not shown, to surface 9 of apertured coupling member 14. The aperture in coupling member 14, just mentioned, is designated as 8, and the aperture in seat 13 is designated as 7. Spring 18 acts to bias coupling member 14, when free to do so, upwardly to a limiting position defined by the bottoms of two diametrically opposite stop members 20, 20 which are rigidly secured to the outer peripheral surface of funnel outlet pipe 10B.

Coupling member 14, as previously described, which includes handle portions 6,6, is adapted to cooperate with and engage a conventional automotive radiator inlet fitment 12. Radiator inlet fitment 12 is provided with a conventional overflow pipe 24 and with a conventional radially outwardly and downwardly extending top flange 26 which is interrupted as is well known by two diametrically opposite grooves 27, only one of which is shown, in FIG. 3, which allow passage of diametrically opposed lugs 28 carried by coupling member 14. Thus, by aligning lugs 28, 28 with grooves 27, 27 and pushing down on member 14 against the bias of spring 18, the lugs 28, 28 may be positioned below the level of flange 26 after which turning of member 14, so that lugs 28, 28 are out of alignment with grooves 27, 27, and release of member 14 will cause coupling member 14, as well as funnel 10 carried thereby, to be releasably coupled, under the bias of spring 18, to fitment 12. Detachment of member 14, and funnel 10 therewith from fitment 12 is accomplished by reversing the procedure just described. When elements 12 and 14 are uncoupled, spring 18 biases member 14 upwardly against stops 20, 20.

Gasket 17 is of a suitable elastic or resilient sealing material such as rubber and is of U-shaped cross-section. Gasket 17 straddles flange 16 at the lower end of funnel outlet pipe 10 and engages both the upper and the lower surfaces of such flange. The portion of gasket 17 which engages the lower side of flange 16 thus serves as a seal by seating against the top of a radially inwardly extending flange 30 carried by the lower end of fitment 12 when member 14 and funnel 10 carried thereby, are coupled to fitment 12, as previously described, and as best illustrated in FIG. 6.

The inwardly extending flange 30 at the lower end of fitment 12 bounds a circular aperture 32 which communicates with passages, to be further described, in funnel outlet pipe 10B when the funnel 10 is mounted in the manner shown by FIG. 6 on either radiator R1 (FIG. 1) or R2 (FIG. 2).

To mount the funnel 10 relative to the fitment 12, as best seen in the view of FIG. 6, the free end of funnel outlet pipe 10 is inserted into the hollow interior of fitment 12 until the bottom of gasket 17 engages inwardly extending flange 30 of fitment 12, and coupling member 14 is then pushed downwardly against the force of spring 18, and rotated until lugs 28 on member 14 move under flange 26 on fitment 12 of the radiator as previously described. When this is accomplished manual pressure on member 14 is released and spring 18 is left compressed between the spring seat defined by the upper surface of gasket 17 on flange 16 at the lower end of funnel outlet pipe 10B, and surface 11 of top spring seat 13. When elements 12 and 14 are so engaged spring 18 causes gasket 17 to seal fairly tightly against flange 30 whereby fluid communication between aperture 32 and overflow pipe 24 is interrupted.

Stated another way, the parts just described are so dimensioned that when member 14 is properly engaged with fitment 12, gasket 17 seats under compression from spring 18 against inwardly extending flange 30 of fitment 12 to provide a seal which substantially prevents any leakage of fluid between elements 17 and 30, and also seals off any escape of fluid through the overflow 24 from either the radiator, or the funnel outlet pipe 10B when the funnel 10 is assembled with the fitment 12 as best seen in FIG. 6. Once the funnel 10 is engaged with fitment 12 as just described, if the conical portion 10A is not in a suitable position to allow filling of a given container having a filling opening of one of the types previously described then funnel 10 can be rotated relative to coupling member 14 until portion 10A is in a suitable position.

As a further feature of my inventive construction, funnel 10 includes a primary vent arrangement generally indicated at 40 which comprises a relatively large venting passage 41 adjacent the wall on the side of funnel 10 which does not underlie baffle member 15. Passage 41 is enclosed by parts of the walls of conical funnel portion 10A and outlet pipe 10B and wall 42. Wall 42 is fastened to 10A and 10B in a leakproof manner by solder, or the like, not shown. Wall 42 extends from near the upper end of conical funnel portion 10A to near the lower end of conical portion 10A from whence it continues downwardly through outlet pipe 10B to the bottom thereof. FIGS. 4, 6, 7 and 8, when considered together, illustrate the rather unusual shape of wall 42 and how its lower portion substantially bisects outlet pipe 10B. Venting passage 41 communicates with the interior of the container being filled whereby air or gas, and any liquid vapors or droplets carried by such air or gas, displaced by the introduction of material from funnel 10 into the container by way of a filling passage 44 in outlet pipe 10B, will pass upwardly through the primary vent passage 41 and thence into the interior of conical portion 10A by way of aperture-forming notches 45, 45 in wall 42, presuming no filling liquid is present in portion 10A above the level of notches 45 which could happen if the funnel 10 is positioned as in FIG. 1. If liquid is poured into portion 10A so as to rise above notches 45 then such liquid will enter venting passage 41 by way of 45, 45, and venting will take place by means of the auxiliary vent/siphon subassembly 21 still to be further described.

Thus, it will be seen that funnel outlet pipe 10B includes two separate and distinct large passages formed by the lower part of wall 42, namely, the filling passage 44, the upper end of which communicates with the lower end of funnel conical portion 10A whereby to provide communication between funnel conical portion 10A and the container to be filled. The second large passage 41 through funnel outlet pipe 10B is part of the primary vent arrangement and normally conducts air or gas vented from the container, as well as any vapor or liquid droplets carried by such vented air or gas, upwardly and out aperture forming notches 45, 45, as the container is being filled.

Circumferentially spaced aperture forming notches 45, 45 through which air or gas, and any vapors or liquid droplets carried by such air or gas, is vented by the primary vent arrangement is discharged into the interior of conical funnel body 10A. The aperture forming notches 45, 45 are positioned in such fashion so as to substantially preclude any significant amount of matter being discharged therethrough from being directed upwardly toward the user of the funnel.

The auxiliary vent/siphon subassembly generally indicated at 21 comprises an angled pipe generally indicated at 21A which may be constructed of rigid material, such as copper and which includes a straight inlet portion, the lower end of which lies within funnel outlet pipe 10B and extends downwardly along wall 42, to which it may or may not be fastened, for example, by soldering, as desired. The straight inlet portion of 21A lying within funnel outlet pipe 10B bends, as illustrated in FIG. 6, and passes upwardly and outwardly through an aperture 23 in the peripheral wall of funnel outlet pipe 10B where it extends exteriorly of outlet pipe 10B for a short distance. The flexible conduit portion 21B, previously described, is fastened at one of its ends, by friction fit or by adhesive, to the upper terminus of pipe 21A which lies outwardly of outlet pipe 10B. The opposite end of flexible conduit 21B is connected to the relatively short rigid discharge tube 21C of the vent/siphon subassembly, as previously described. Solder, or other sealant, may be applied between pipe member 21A and the part of the funnel outlet pipe 10B which surrounds aperture 23 so that no fluid can escape around the outside of pipe 21A through 23.

When the funnel and vent/siphon assembly 10 is being used to fill a container such as the radiator of an automotive vehicle, in either the FIG. 1 or FIG. 2 environments, the discharge tube 21C of the vent/siphon subassembly 21 is engaged or "parked" within aperture 19 in baffle 15, as previously described, whereby any air or gas discharged from the radiator through the flow path of the vent/siphon subassembly, such flow path consisting of 21A, 21B and 21C, during the container filling operation is directed downwardly into the interior of funnel 12 beneath baffle 15, thereby substantially preventing any impingement of the vented air or gas or of any material entrained therein onto the person using the funnel. This is a safety feature provided by the construction of the present invention. The combined venting capacity of the primary and auxiliary vents provides sufficient venting to allow rapid filling of a given container with the funnel assembly herein described.

If, upon the completion of the container filling operation there is an excess of liquid remaining in the conical portion 10A of the funnel, the discharge tube 21C of vent/siphon subassembly 21 may be disengaged from aperture 19 of baffle 15 and moved downwardly to the dotted line positions shown in FIGS. 1 or 2 in which positions the vent/siphon subassembly may serve as a siphon to drain excess fluid from the funnel and into a suitable container (not shown) which may be provided to receive such excess as it discharges from the vent/siphon subassembly. Siphon action will be self-starting if excess liquid in the funnel portion 10A rises to a level above the highest point of flexible conduit 21B when 21B is in the dotted-line FIG. 1 or FIG. 2 positions, and will continue, unless interrupted, until the liquid in the funnel drops to the level of the bottom of pipe 21A since at this time air will enter the siphon pipe 21A from passage 44 and will break the siphon action. If the excess liquid in portion 10A is not sufficiently high to make the siphon action of vent/siphon subassembly 21 self-starting, as just described, a user can pour more liquid into 10A until such self-starting action takes place. Proper utilization of the vent/siphon subassembly 21 as a siphon allows complete emptying of the funnel 10 so that it can then be uncoupled from the container which it is being used to fill without wastage of fill liquid and without danger of spilling fill liquid on a user during funnel uncoupling.

Although reference has been made hereinabove to the use of metal in fabricating portions of funnel 10, some or all of funnel 10, as well as coupling member 14 can be made of plastic materials, if one should desire to do so. Or a mixture of metal and plastic parts may be utilized if desired.

Also, although a lug-type engagement is shown between elements 12 and 14, other types of engagements such as bayonet or threaded can also be utilized, if desired.

From the foregoing detailed description of the invention, it has been shown how the objects of the invention have been obtained in a preferred manner. However, modifications and equivalents of the disclosed concepts as readily occur to those skilled in the art are intended to be included within the scope of the invention.

I claim:

1. A funnel comprising a hollow conical portion having a large, rimmed, mouth end and a small outlet end adapted to receive a fluent material to be dispensed, said funnel including an outlet pipe rigidly secured to the outlet end of said hollow conical portion, said outlet pipe having a longitudinal axis which is at an angle relative to the axis of symmetry of said conical portion, said funnel including a coupling member adapted to be detachably coupled to the fill opening of a container to be filled by said funnel, said coupling member having a passage therethrough receiving said outlet pipe, said funnel being rotatable relative to said coupling member about the longitudinal axis of said outlet pipe so as to permit adjustment of the filling position of said conical funnel portion relative to the container to be filled.

2. A funnel as defined in claim 1 in which the longitudinal axis of said outlet pipe is at an angle of substantially 45 relative to the axis of symmetry of said conical portion of said funnel.

3. A funnel as defined in claim 1 in which said coupling member is slidably movable along said outlet pipe.

4. A funnel as defined in claim 1 including primary vent means including a wall portion forming, in conjunction with portions of said hollow conical portion and said outlet pipe of said funnel, vent passage means extending from near the top of said conical portion to the lower end of said outlet pipe for receiving matter displaced from a container being filled when said funnel is mounted on such container being filled, and for discharging said matter displaced from the container being filled into said conical portion.

5. A funnel as defined in claim 1 including a baffle member extending radially inwardly from a portion of the rim of said conical portion and covering a substantial portion of the mouth of said conical portion whereby said baffle serves as a dam which assists in preventing loss of fluent material from said conical portion when said axis of symmetry of said conical portion is inclined relative to the vertical.

6. A funnel as defined in claim 1 including a vent/-siphon subassembly, said vent/siphon subassembly including conduit means having an inlet located adjacent the free end of said outlet pipe adapted to place said conduit means in fluid communication with a container to be filled by said funnel member, and adapted also to place said conduit means in fluid communication with said funnel conical portion, said conduit means including a fluid outlet, and means carried by said conical portion detachably engaging the outlet of said conduit in a "parked" position in which any discharge from said outlet of said conduit is directed downwardly into the interior of said funnel conical portion.

7. A funnel as defined in claim 6 in which said conduit means is flexible for at least a portion of the length thereof to permit said outlet of said conduit means when desired to be moved downwardly from said "parked" position to provide a siphoning and draining action on liquid in said conical funnel portion and outlet pipe to permit discharge of such liquid through said outlet of said conduit means.

8. A funnel as defined in claim 6, said means carried by said conical portion comprising a baffle member provided with an aperture therethrough, said outlet of said conduit means being engageable with said aperture means to maintain said outlet of said conduit means in said "parked" position.

9. A funnel as defined in claim 3 comprising a spring positioned about said outlet pipe beneath said coupling member, said outlet pipe including an integral radially outwardly extending flange at the lower end thereof, the upper surface of said flange having thereon means defining a first seat for the lower end of said spring, the upper end of said spring bearing against a second seat on the under surface of said coupling member, said spring being adapted to be compressed between said first and second seats when said coupling member is engaged with said fill opening of the container being filled.

10. A funnel as defined in claim 9 including stop means above said coupling member and rigid with the exterior of said outlet pipe for limiting upward movement of said coupling member when said funnel is detached from the fill opening of said container.

11. A funnel as defined in claim 1 in which the fill opening of the container being filled is provided with an inlet fitment, and said coupling member is adapted to be detachably coupled to said inlet fitment by a lug type of connection.

12. A funnel as defined in claim 1 in which the fill opening of the container being filled is provided with an inlet fitment, and said coupling member is designed to be detachably coupled to said inlet fitment by a screw thread type of connection.

13. A funnel assembly as defined in claim 1 in which the fill opening of the container being filled is provided with an inlet fitment, and said coupling member is adapted to be detachably coupled to said inlet fitment by a bayonet type of connection.

14. A funnel as defined in claim 9 adapted for use in filling a container provided with an installed inlet fitment having a radially inwardly extending flange wherein a seal attached to the bottom of the outwardly extending flange on said outlet pipe seats and forms a seal under the compression force of said spring against said radially inwardly extending flange of said inlet fitment when said coupling member is detachably coupled with said inlet fitment of said container being filled.

15. A funnel as defined in claim 1 wherein the container being filled is the radiator of an automotive vehicle, which radiator is provided with an installed inlet fitment providing said fill opening and including means adapted to provide a seal between said outlet pipe and said fitment when said funnel is detachably coupled to said fill opening.

* * * * *